United States Patent [19]

Ohling

[11] 4,107,943

[45] Aug. 22, 1978

[54] FREEZING APPARATUS AND METHOD

[75] Inventor: Robert S. Ohling, San Jose, Calif.

[73] Assignee: Acoolco Corporation, Watsonville, Calif.

[21] Appl. No.: 583,196

[22] Filed: Jun. 2, 1975

[51] Int. Cl.[2] ..... F25C 5/02

[52] U.S. Cl. ..... 62/320; 62/347; 62/352; 241/274

[58] Field of Search ..... 62/347, 348, 320, 352, 62/DIG. 2; 239/193; 241/301, 95, 274

[56] References Cited

U.S. PATENT DOCUMENTS

| | | | |
|---|---|---|---|
| 2,091,772 | 8/1937 | Steele | 241/274 X |
| 2,524,815 | 10/1950 | Leeson | 62/347 X |
| 2,696,352 | 12/1954 | Bozichovich | 241/301 |
| 2,962,869 | 12/1960 | Bartels | 62/348 X |
| 3,228,202 | 1/1966 | Cornelius | 62/320 X |
| 3,246,481 | 4/1966 | Douglas et al. | 62/347 X |
| 3,290,025 | 12/1966 | Engalitcheff, Jr. | 239/193 X |
| 3,423,952 | 1/1969 | Pugh | 62/347 X |
| 3,430,452 | 3/1969 | Dedricks et al. | 62/347 X |
| 3,722,230 | 3/1973 | Scott et al. | 62/DIG. 2 |
| 3,792,594 | 2/1974 | Kramer | 62/503 |
| 3,913,349 | 10/1975 | Johnson | 62/348 X |

*Primary Examiner*—William E. Wayner
*Assistant Examiner*—William E. Tapolcai, Jr.
*Attorney, Agent, or Firm*—Sam E. Laub

[57] ABSTRACT

A freezing apparatus has at least one evaporator assembly with two freezing faces in the form of large planiform surfaces. The evaporator assembly has at least one chamber portion defined by the freezing faces and an outer annulus that is connected to a substantial portion of the periphery of the freezing faces. Liquid delivery means delivers the liquid to be frozen to an overflow trough means that is mounted on the evaporator assembly so that the liquid overflows from the trough means across the freezing face. There is means for heating and cooling the freezing faces of the evaporator assembly, and the freezing faces can continuously go through a cycle of cooling so as to freeze the liquid onto the faces and heating so as to release the frost bond between the sheets of frozen liquid and the freezing faces. Recipient trough means is positioned to receive liquid falling from a liquid guide attached to the evaporator assembly, and the recipient trough means has protruding breaker portions positioned so that sheets of frozen liquid released from the freezing faces fall into contact with the portions and are broken into fragments that fall from the recipient trough means for collection. In a preferred embodiment, a multiplicity of evaporator assemblies are utilized with each assembly having a mounted overflow trough means, a separate outlet from the liquid delivery means and associated recipient trough means. Also disclosed is a method of freezing a liquid and a preferred utilization of the freezing apparatus for freezing water into sheets of ice that are broken into fragments for utilization as fragmented ice.

26 Claims, 6 Drawing Figures

FREEZING APPARATUS AND METHOD

BACKGROUND OF THE INVENTION

This invention relates to an improved freezing apparatus and more particularly to a plate type freezing apparatus and method of using this apparatus in a continuous manner for freezing liquid in the form of a sheet or slab that is pure and free from air bubbles and needles and then fragmenting the frozen sheet into fragments as it is harvested.

In many businesses, ice is required in the form of fragments and this fragmented form is preferred to other forms such as cubes or crushed ice. It is a preferred object of this invention to provide an improved apparatus and method of using this apparatus for freezing water into sheets of ice and breaking the sheets of ice into fragments form.

Ice in fragments of varying thicknesses has a variety of uses in industry. One use is for the icing of fishing boats during which fishing boats take aboard ice, preferably in fragmented form to cool the fish catch at sea. Depending on size, boats will take on from 1 to 60 tons of fragmented ice at one loading, and the fish boat icing stations vary in size to suit the needs of the local fishing fleet. Another use for fragmented ice is in poultry processing plants in chill tanks to remove rapidly the body heat from the fowl. A further use for fragmented ice is in the cooling of concrete batches for large concrete structures such as dams, tunnels and heavy earth retaining walls. In some chemical processes, there is a need for fragmented ice for batch cooling and some processes have requirements of up to 100 tons per day. Still other uses of fragmented ice include catering truck icing, sausage making, railway car and field truck icing and some distribution as cocktail ice due to fragmented ice having a lower production cost than cubes.

Automatic ice making apparatus involving reversible cycle refrigeration systems for producing fragmented ice are currently in wide commercial use. In such systems, ice is produced during the normal refrigerating or freezing phase of the apparatus when condensed liquid refrigerant is admitted to the evaporator or evaporator assembly, and the ice is discharged from the evaporator during the defrosting or harvesting phase when hot gaseous refrigerant is delivered directly from the compressor to the evaporator. Some systems have customarily involved an evaporator with a refrigerant chamber having a large volume of liquid refrigerant at the conclusion of the freezing cycle, and one approach has involved rapidly dumping substantially all of the liquid refrigerant from the evaporator into a storage unit at the commencement of the harvesting cycle while introducing the hot gaseous refrigerant in a manner to avoid melting of the ice while achieving release of the frost bond between the ice and the ice-forming or freezing surfaces of the evaporator.

Another system described in U.S. Pat. No. 3,280,585 avoids the dumping or storing of the liquid refrigerant remaining in the evaporator at the conclusion of the freezing cycle by introducing the hot gaseous refrigerant into the refrigerant chamber of the evaporator so that the hot gaseous refrigerant is placed in effective thermal exchange relation with the liquid refrigerant throughout the entire height of the body of liquid refrigerant. This quickly vaporizes the liquid refrigerant or warms it sufficiently to release the frost bond holding the ice to the ice-forming surfaces of the evaporator.

This patent uses a simple and effective method of producing and harvesting ice by utilizing a flooded evaporator principle in which no expansion valve is incorporated in the high pressure side of the system and in which no refrigerant is added to the evaporator during the freezing cycle. This patent has an evaporator structure upon which the ice is formed. This ice making apparatus delivers the water to be converted to ice by a water spray header above the evaporator with a pair of parallel horizontal header pipes having upwardly directed spray nozzles for delivering the water in the form of a spray to the large planiform surfaces of the evaporator. The harvested ice from the apparatus of this patent is received in an ice crusher and conveyor assembly operating on the conveyor screw principle, and this crushes the sheet ice discharged from the evaporator.

Another freezing apparatus for freezing liquid is described in U.S. Pat. No. 2,826,045 having at least one freezing plate with a freezing channel, and the plate is generally inclined from the vertical. Means in the form of a liquid distribution unit or pipe having a slit-like nozzle delivers a stream of liquid to be frozen at periodic intervals into the intake end of the channel. A tank is disposed adjacent the discharge end of the channel for recovering any liquid discharged from the channel, and the tank is adapted to be removed from adjacent to the discharge end of the channel at predetermined intervals. A belt is provided so that when the tank is removed from being adjacent to the discharge end of the channel during harvest, the frozen cakes fall from the freezing plates onto the belt which conveys the cakes to a hopper.

It has remained desirable to have a freezing apparatus that utilizes a minimum of energy in the production of fragmented frozen liquids, particularly fragmented ice. In particular it is desirable to eliminate the use of mechanical means to fragment the frozen liquid since this involves the use of energy and the potential of a mechanical failure with the resulting loss of production time during repairs. It is also desirable to have a freezing apparatus that does not use spray means or nozzles for delivery of the liquid since spray nozzles are subject to plugging with particulate matter in the liquid delivery line or in the nozzle with the resulting loss of time and production during unplugging of the line or nozzles. Also the use of spray nozzles can result in the splashing of liquid to areas adjacent the evaporator assembly and this can result in wetting and freezing together of the frozen liquid fragments being harvested when splashed liquid contacts the harvested fragments. It is also desirable to have instrumentation controlling the thickness and the hardness of the frozen liquid sheet. It is also desirable to have a freezing apparatus and associated handling equipment that is completely sanitary for use with food products and constructed to be safe for operating personnel.

OBJECTS OF THE INVENTION

Accordingly it is an object of this invention to provide a freezing apparatus that utilizes a minimum of energy in the production of fragmented frozen liquids through the elimination of mechanical means for fragmenting the frozen liquid.

Another object of this invention is to provide a freezing apparatus for producing fragmented frozen liquids that has a minimum of moving mechanical components to avoid mechanical failures and the loss of time and production.

Still another object of this invention is to provide a freezing apparatus that utilizes an overflow trough means either fixedly or adjustably mounted on the evaporator assembly for delivering the fluid to the freezing faces of the assembly, thus avoiding the use of spray nozzles that are subject to plugging and the loss of time and production.

A further object of this invention is to provide a freezing apparatus that has a recipient trough means positioned to receive liquid falling from the evaporator assembly and the trough means has protruding breaker portions positioned so that sheets of frozen liquid released from the freezing faces of the evaporator assembly fall into contact with the breaker portions and are broken into fragments.

Another object of this invention is to provide instrumentation for automatically operating the freezing apparatus in a manner controlling the thickness and the hardness of the frozen liquid sheet.

An additional object of this invention is to provide a freezing apparatus and associated equipment that is capable of being maintained in a completely sanitary condition for use with food products.

Another object of this invention is to provide a freezing apparatus that is constructed and operated in a manner that is safe for personnel working with the apparatus.

Still another object of this invention is to provide an improved evaporator assembly having an annulus around the periphery of the freezing faces of the assembly to define at least one chamber or chamber in the assembly and to speed the harvest of frozen liquid sheets by first introducing the hot gaseous refrigerant into the annulus so that the frost bond between the sheets and the freezing faces is first released at the periphery of the freezing faces.

A further object of this invention is to provide an overflow trough either fixedly or adjustably mounted on the evaporator assembly in order to provide uniform delivery of liquid to the freezing faces resulting in the uniform thickness of the sheet of frozen liquid accumulated on the freezing faces.

Other objects and advantages of this invention will become apparent to a person skilled in the art from a reading of the following specification with reference to the drawings and from the appended claims.

SUMMARY OF THE INVENTION

The foregoing objects and others are accomplished in accordance with this invention by providing a freezing apparatus having at least one evaporator assembly with two freezing faces that in a preferred embodiment are positioned to be substantially vertical. The evaporator assembly has at least one chamber or chamber portion defined by the freezing faces and an outer annulus that is connected to a substantial portion of the periphery of the freezing faces. One preferred embodiment has three chambers defined by the freezing faces, their affixed pressure plates and the outer annulus that is connected to a substantial portion of the periphery of the freezing faces. Liquid delivery means delivers the liquid to be frozen to an overflow trough means (overflow trough) that is either fixedly or adjustably mounted on the outer annulus of the evaporator assembly so that liquid delivered to the overflow trough means builds up and overflows from the trough means and runs across the freezing faces from one end to the other where the fluid encounters a drainage guide protruding from the side of the evaporator assembly opposite the overflow trough. There is means for heating and cooling the freezing faces of the evaporator assembly in a reversible cycle and the freezing faces can continuously go through this cycle of cooling so as to freeze the liquid onto the freezing faces and heating so as to release the frost bond between the sheets of frozen liquid and the freezing faces. In one preferred embodiment the means for heating and cooling consist of a first line (pipe line) connected to the evaporator assembly and this first line connects the liquid outlet of an accumulator to the evaporator assembly. A second line (pipe line) is a suction return line that returns the liquid and gaseous refrigerant to the accumulator from the evaporator assembly. A third line is connected to the liquid side of the accumulator and to the gaseous side of the accumulator, and in this third line there is a compressor, a condenser and a receiver or a combination condenser-receiver. A fourth line serves as the drain line for returning the liquid refrigerant from the evaporator assembly to the accumulator during the harvest cycle and this fourth line runs between the first line and the liquid refrigerant side of the accumulator. A fifth line runs from the third line to the outer annulus of the evaporator assembly and is used to provide the hot gaseous refrigerant to the annulus and the evaporator assembly during the harvest cycle.

Recipient trough means (recipient trough) is positioned to receive liquid falling from the drainage guide of the evaporator assembly and the recipient trough means has protruding breaker portions positioned so that sheets of frozen liquid released from the freezing faces fall into contact with the breaker portions and are broken into fragments that fall from the protruding breaker portions for collection. The recipient trough has an outlet directing the liquid collected from the evaporator assembly to the liquid delivery means for recycling to the overflow trough means. In one embodiment the recipient trough has the two protruding breaker portions attached to the base of the trough so as to form an angle in the range of about 15° to about 60° with the base.

In a preferred embodiment a multiplicity of evaporator assemblies are utilized for freezing liquid with each assembly having a mounted overflow trough means and an associated recipient trough means. In this embodiment the means for heating and cooling the freezing faces is operatively connected to the multiplicity of evaporator assemblies and the liquid delivery means has multiple outlets for delivering the liquid to the mounted overflow troughs.

The freezing apparatus has an electrical circuit capable of controlling the thickness and hardness of the sheet of frozen liquid and capable of providing a responsive change in the thickness of the sheet of frozen liquid by a change in the instrumentation setting and a change in the ice hardness by a change in the instrumentation setting. Control valves have solenoid coils controlling the flow of cold liquid refrigerant and hot gaseous refrigerant to the evaporator assembly and these valves are opened on energization and closed on de-energization of the associated solenoid coils. These control valves are connected to a timing means, a voltage source, switching means and a ground so that the timer actuates the controls valves according to a predetermined sequence.

A method of freezing a liquid is accomplished in accordance with this invention by practicing the following steps. First a supply of the liquid to be frozen and freezing zones for freezing the liquid are established. The liquid from the supply is delivered so that the liquid runs across the freezing zone. The liquid not frozen on the freezing zones is collected for return to the supply. After sufficient liquid is frozen on the freezing zones, the delivery of the liquid is stopped and the freezing step is continued sufficiently to harden the frozen liquid. The freezing zones are then heated sufficiently to harvest the sheet of frozen liquid by thawing the bond between the freezing zone and the sheet. In practice the heating of the freezing zones is conducted so that the periphery of the freezing zones is heated first. The harvested sheets of frozen liquid are released by gravity dropping from the freezing zones into a fragmenting zone that utilizes the force of gravity to fragment the sheet. Thereafter the fragments of frozen liquid are collected in a collection zone.

The freezing apparatus of this invention can be utilized for freezing any liquid of low volatility and, representative examples are water, salt water, vinegar and liquid organic chemicals such as paradichlorobenzene. A preferred utilization of the freezing apparatus is for freezing water into sheets of ice that are broken into fragments for utilization as fragmented ice.

BRIEF DESCRIPTION OF THE DRAWINGS

Details of the invention, and of a preferred embodiment thereof, will be further understood upon reference to the drawings, wherein.

DETAILED DESCRIPTION OF THE INVENTION

Figure 1:
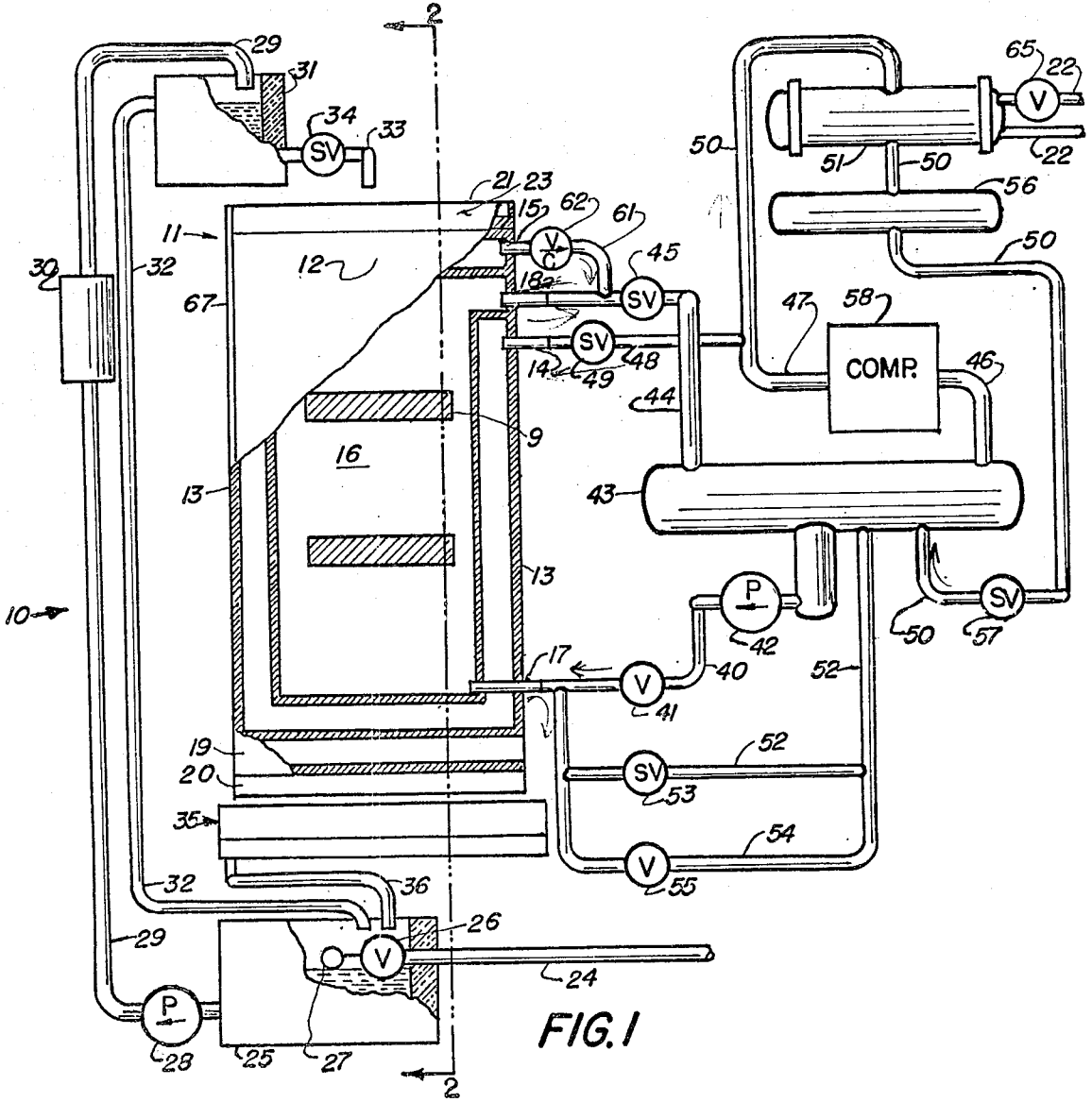
FIG. 1 is a schematic of a freezing apparatus in a partial sectional elevation view according to the teaching of this invention.
Figure 2:
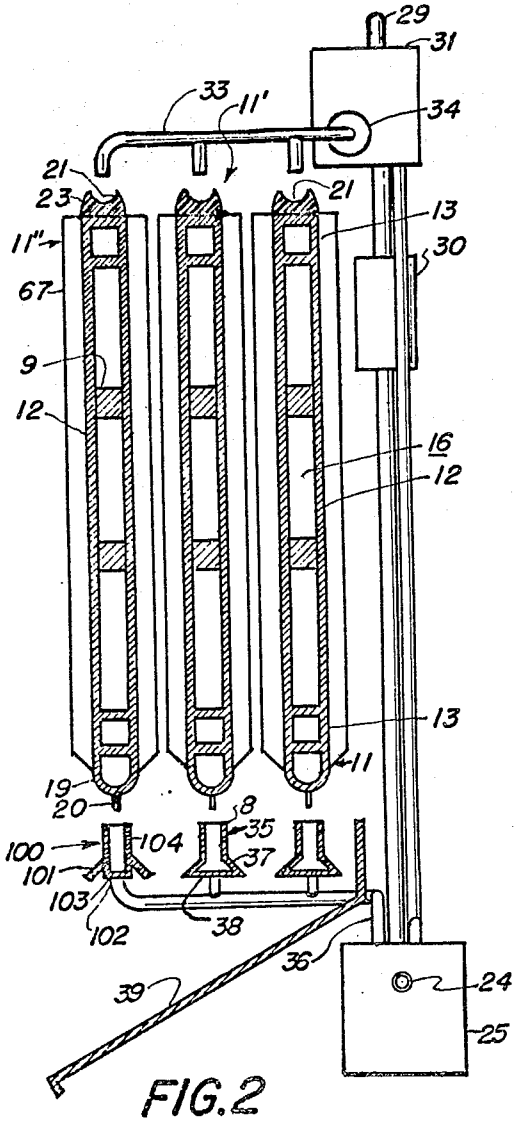
FIG. 2 is a side sectional elevation view of the apparatus of FIG. 1 taken along line 2—2 in FIG. 1 and showing the cut away evaporator assemblies in FIG. 1.
Figure 6:
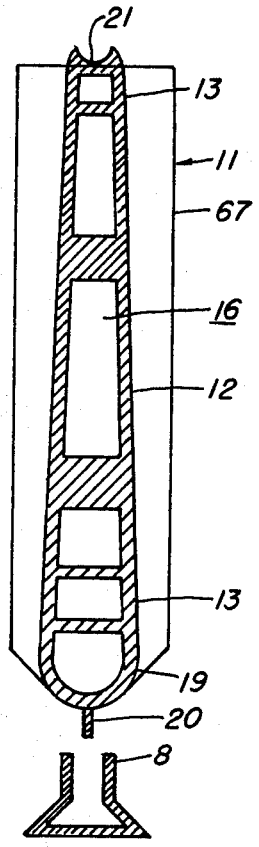
FIG. 6 is a sectional side elevation view of another embodiment of the freezing apparatus of this invention in which both of the freezing faces are inclined from the vertical.

In FIGS. 1 and 2 there is shown a freezing apparatus generally designated by the number 10 having at least one evaporator assembly 11, and preferably a multiplicity of evaporator assemblies 11, 11' and 11" as shown in FIG. 2 with each assembly having two freezing faces 12. In one preferred embodiment the freezing faces 12 are positioned to be substantially vertical, however the freezing faces 12 can be inclined from the vertical. In one embodiment both of the faces are inclined from the vertical in opposite directions thus giving a cross section of a truncated isosceles triangle. In another embodiment both of the faces are inclined in opposite directions from the vertical and at substantially the same angle from the vertical as shown in FIG. 6. This description will be given with reference to evaporator assembly 11, it being understood that assemblies 11' and 11" have the same components. Evaporator assembly 11 is provided with an outer annulus 13 having a contained volume, and annulus 13 is connected to a substantial portion of the periphery of the freezing faces 12 of the evaporator assembly 11. The annulus 13 has an entry port 14 and an exit port 15. Annulus 13 is connected to the freezing faces 12 such as by welding and substantially surrounds the central reservoir or chamber 16 between the freezing faces 12. Means for stabilizing the freezing faces 12 in the form of members 9 are fixedly mounted (such as by welding) between the freezing faces 12 to prevent bowing of these faces 12. The chamber 16 is defined by the freezing faces 12 and the annulus 13 and any gases or liquids in the chamber 16 are in thermal contact with the freezing faces 12. Ports (tubes) 17 and 18 are provided for the introduction and removal of fluids for chamber 16. The port 17 is shown in FIG. 1 passing through outer annulus 13, however, port 17 only occupies a portion of the cross section of annulus 13 enabling flow in annulus 13 past port 17. The periphery of freezing faces 12 adjacent port 18 is the only portion of the periphery not connected to the annulus 13. Rounded compartment (segment) 19 of evaporator assembly 11 is connected to annulus 13 (such as by welding) and is provided as an inaccessible dead space. Segment 19 has a generally rounded cross section (a narrowing cross section) providing a rounded end to the evaporator assembly so that liquid flowing across the freezing faces 12 follows the surface of segment 19 to drainage guide 20. Guide 20 serves to direct liquid from evaporator assembly 11 to recipient trough means (recipient trough) 35, and guide 20 can preferably be non-conductive material such as a plastic with Plexiglass being preferred. Flow guides 67 are provided at the edge of evaporator assembly 11 in order to prevent flow of the liquid off the side of the freezing faces 12.

Overflow trough means (overflow trough) 21 is mounted on the flat surface of the outer annulus 13 of evaporator assembly 11, and the overflow trough 21 has a reservoir and sloped sides 23 enabling overflow of liquid onto the freezing faces 12. Overflow trough 21 can be fixedly mounted as shown in FIGS. 1 and 2 through use of brackets or welding. In this manner, a liquid delivery means or system is provided for delivering liquid to the reservoir of trough 21. A liquid line 24 having float valve 26 and float 27 admits liquid to insulated liquid reservoir 25 and float valve 26 controls the liquid level in reservoir 25. Pump 28 constantly operates and pumps water through line 29 and filter means 30 to insulated liquid supply tank 31. Tank 31 has overflow line 32 delivering any overflow liquid to insulated liquid reservoir 25 and outlets 33 are provided at the bottom of tank 31 for gravity feed of liquid from tank 31 through water solenoid valve 34 to the overflow troughs 21 at the top of each evaporator assembly 11, 11' and 11".

Separate recipient trough means (recipient troughs) 35 and 100 in the form of drainage troughs are positioned to receive liquid that does not freeze on freezing faces 12 of the associated evaporator assemblies 11, 11' and 11" and drainage guides 20 of the evaporator assemblies direct such liquid into the opening or mouth of recipient troughs 35 and 100. Trough 35 has outlet 36 directing the collected liquid to insulated liquid reservoir 25, and trough 35 has the base 38 connected to two protruding breaker portions 37 comprised of substantially planar surfaces which are connected to sides 8 that form a mouth or openings for receiving liquid. The protruding breaker portions 37 extend sufficiently so sheets of frozen liquid released from each freezing face 12 of the associated evaporator assembly 11 encounter the respective protruding breaker portion 37 positioned beneath the freezing face 12. The portions 37 can form an angle in the range of about 15° to about 60° with the base 38 of trough 35. Another embodiment of the recipient trough 100 has a base 103 connected to sides 104 and protruding breaker portions 101 comprised of substantially planar surfaces that extend sufficiently to encounter the ice sheets falling from the freezing faces 12 of the associated evaporator assembly 11''. An outlet 102 connects to outlet 36 and drains liquid to the insulated reservoir 25.

Beneath the troughs 35 and 100 in FIG. 2 is shown an ice discharge chute 39 that receives fragments of ice from the portions 37 of troughs 35 and portions 101 of trough 100 and directs these fragments to a storage area. The ice discharge chute 39 is omitted from FIG. 1 for clarity of illustrating the other elements in FIG. 1.

The foregoing discussion has made reference to the fact that there is at least one evaporator assembly 11 and preferably a multiplicity of the evaporator assemblies 11, 11' and 11'' with a preferred minimum being three evaporator assemblies and often a freezing apparatus may have 20 or more evaporator assemblies 11. Each evaporator assembly 11 has a mounted overflow trough 21, a separate outlet 33 from the liquid supply tank 31 for delivering liquid to trough 21 and a recipient trough 35 (or 100) as well as being connected to the means for alternately heating and cooling the freezing faces of the evaporator assembly 11 which will be described in greater details in the following paragraphs.

Further the evaporator assemblies 11, 11' and 11'' with mounted overflow troughs 21, the liquid delivery means and recipient troughs 35 and 100 are enclosed in a convenient and compact manner in a frame (not shown for clarity of illustration). In the case of the evaporator assemblies 11, 11' and 11'', the fluid delivery means and the recipient troughs 35 and 100, the frame is used for supporting these components in a fixed position. For efficiency of operation insulation of the frame is provided.

A freezing unit comprised of the evaporator assemblies 11, 11' and 11'', mounted overflow troughs 21, fluid delivery means and recipient troughs 35 and 100, as enclosed in a frame, form a freezing apparatus when connected to any given means for alternately heating and cooling the freezing faces (a refrigeration system), and such a unit is readily connected to a given refrigeration system to form a freezing apparatus.

One freezing system in the form of means for heating and cooling the freezing faces 12 of the evaporator assembly 11 is provided and will be described in detail for only evaporator assembly 11 with reference to FIG. 1. Entry port 17 to the central reservoir 16 of evaporator assembly 11 is connected to a line 40 having flow regulating check valve 41 and line 40 leads to refrigerant pump 42 and the refrigerant outlet side of accumulator 43. Another line 52 (accumulator return line) with solenoid valve (drain valve) 53 is connected to line 40 between the flow regulating check valve 41 and entry port 17, and line 52 leads from line 40 to the refrigerant side of accumulator 43. By-pass line 54 with pressure regulating valve 55 is provided as a by-pass to drain valve 53 for line 52. Exit port 18 leading to reservoir 16 of the evaporator assembly 11 is connected to line 44 having a solenoid valve (suction valve) 45 in line 44, and line 44 leads to the gas return side of accumulator 43. Exit port 15 of annulus 13 is connected to line 61 having check valve 62 in line 61 and line 61 is connected to line 44 between exit port 18 and solenoid valve 45. The accumulator 43 is connected by flow line 46 to compressor 58 and compressor discharge line 47 leads from the compressor 58 to a tee with annulus feed line 48 and condenser line 50. Line 48 has a hot gas solenoid valve 49 and leads to entry port 14 of outer annulus 13 while condenser line 50 connects shell and tube condenser 51, receiver 56 and liquid feed (solenoid) valve 57 to the refrigerant side of accumulator 43. Shell and tube condenser 51 has water feed line 22 with pressure regulating valve 65 and water discharge line 22'.

The freezing apparatus of this invention is capable of receiving either a halocarbon or ammonia refrigerant and uses either a direct expansion or a liquid recirculation type of liquid feed. FIG. 1 shows a liquid recirculation type of liquid feed.

The method of freezing a liquid according to this invention will now be described with reference to evaporator assembly 11 of FIGS. 1 and 2 for the preferred practice in which the liquid is water and the sheets of frozen liquid are ice. First a supply of water is established in insulated liquid reservoir 25 and pump 28 is started to pump the water to water supply tank 31. Compressor 58, condenser 51, receiver 56, accumulator 43 and refrigerant pump 42 are actuated and valves 41 and 45 are opened so that liquid refrigerant is delivered in line 40 to central reservoir 16 and the evaporation of the refrigerant cools freezing faces 12 of each evaporator assembly 11. Then water solenoid valve 34 is opened to deliver fluid from fluid supply tank 31 to overflow trough 21. The fluid builds up in the reservoir of trough 21 and flows over the sloped sides 23 across the freezing faces 12 within flow guides 67. The water not frozen on the freezing faces 12 flows to rounded segment 19 of the evaporator assembly 11 and the water is directed by guide 20 to recipient trough 35 which directs the collected liquid through outlet 36 to insulated liquid reservoir 25. The gaseous refrigerant flows from central reservoir 16 out exit port 18 into line 44 and to the gaseous return side of accumulator 43. The gaseous refrigerant in line 46 flows from accumulator 43 through compressor 58 and through line 50 to condenser 51 and receiver 56 resulting in condensation and cooling of the gaseous refrigerant to a liquid that is delivered through valve 57 to the refrigerant side of accumulator 43 for pumping through pump 42 in line 40 to chamber 16. During this part of the cycle valves 49, 62, 53 and 55 are closed while valves 41, 45 and 34 are open.

After sufficient water is frozen on freezing faces 12, the harvesting portion of the cycle is started by closing the liquid solenoid valve 34 to stop delivery of the liquid through outlet 33 to the overflow trough 21 and the freezing faces 12. At this point the ice on the freezing faces is allowed to remain on the freezing faces for a given period of time to harden the ice. Then valves 41 and 45 are closed while valves 49 and 53 are opened. This allows hot compressor discharge gas in line 48 to pass through control valve 49 and into outer annulus 13. This produces one of the unique advantages of the method of this invention in that the hot compressor discharge gas makes a complete circuit through outer annulus 13 before entering line 61 and passing through check valve 62 into line 44 and then reservoir 16. This results in the initial thawing of the frost bond between the frozen sheet of ice and the freezing faces at the outer periphery of the freezing faces, the portion from which it is most difficult to release the frost bond by past experience with a plate type freezing apparatus. The gas pressure builds up in reservoir 16 forcing the liquid refrigerant out of reservoir 16 at exit port 17. After the liquid refrigerant is forced from reservoir 16, valve 53 is closed and the hot gas warms the freezing faces sufficiently to thaw the frost bond between the frozen sheet and the freezing faces sufficiently to drop the frozen sheets from the freezing faces. The frozen sheets slide down each freezing face and strike the protruding breaker portions 37 of drainage trough 35, shattering the ice sheet into fragments which is another of the unique advantages of this invention in that the force of gravity displaces the use of mechanical means in fragmenting the frozen ice sheet. This gives an energy savings over other ice makers using energy driven mechanical means to fragment the frozen sheet.

Pressure regulating relief valve 55 serves to maintain sufficient pressure of the compressor gas to melt ice and passes liquid condensate back to the accumulator 43 in lines 54 and 52. After the harvest of the frozen sheets is complete, valve 49 is closed and usually after a delay, valve 34 is opened to start water flowing into overflow trough 21 and onto the freezing faces 12. After a further delay, valve 45 is opened and liquid pressure opens valve 41 to resume flow of the liquid refrigerant for the next freezing cycle. Check valve 62 is closed and prevents backflow of the refrigerant into annulus 13.

For a liquid recirculation refrigeration system as shown in FIG. 1, the system would have a liquid feed valve 57 in the line connecting the accumulator 43 to the receiver 56, and a water flow regulating valve 65 in water supply line 22 which maintains sufficient condensing pressure in condenser 51 to assure a supply of hot gas during the harvest cycle. If a system having a direct expansion type of refrigeration is used, a thermal expansion valve and a liquid solenoid valve would be installed in conjunction with control valve 41, and the solenoid valve energization circuit (described below) would be connected in parallel with valve 45.

Figure 4:
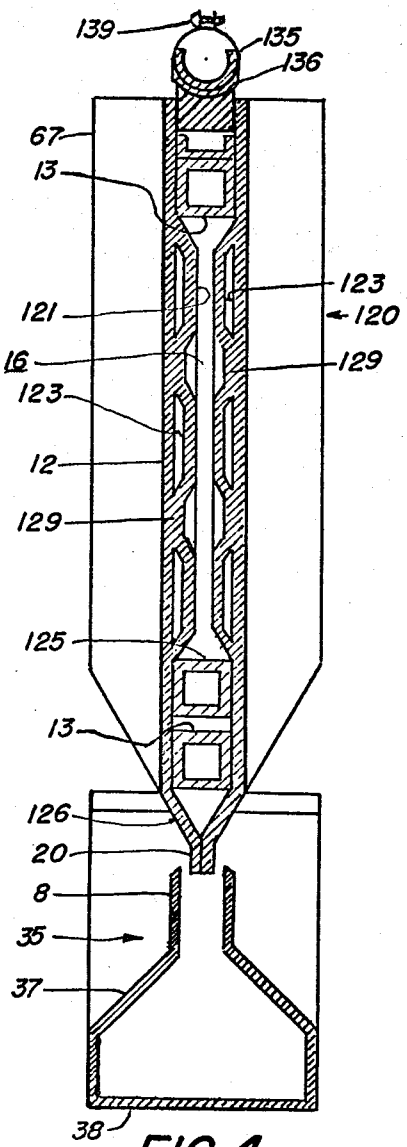
FIGS. 3 and 4 are respectively a partial sectional elevation view and a sectional side elevation view taken along lines 4—4 in FIG. 3 of another embodiment of the evaporator assembly suitable for use in the freezing apparatus of FIG. 1.
Figure 3:
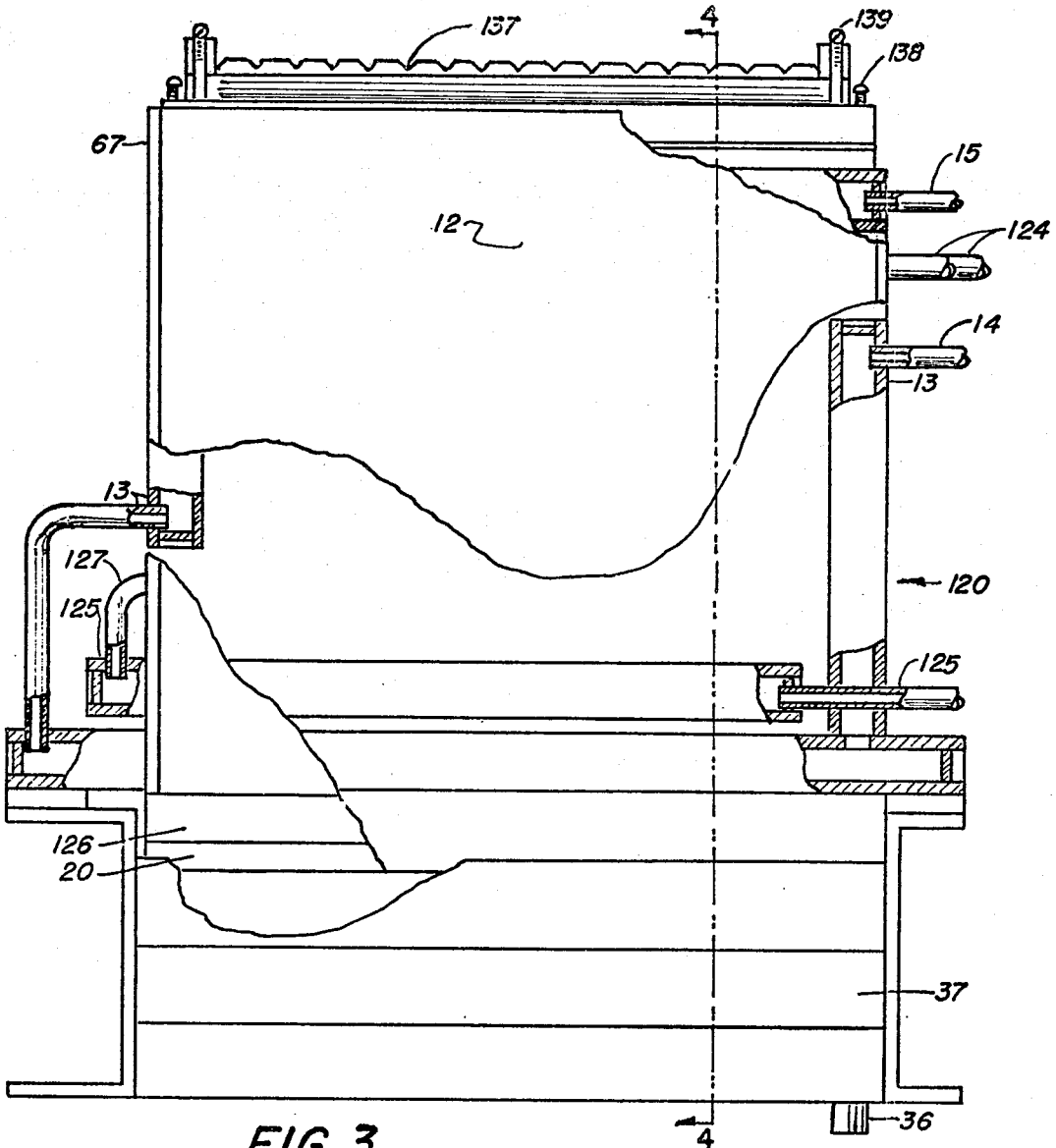

Another embodiment of an evaporator assembly 120 for use in the freezing apparatus of FIG. 1 is presented in a partial sectional elevation view in FIG. 3 and in a sectional side elevation view in FIG. 4 with like components to those of the evaporator assemblies in FIGS. 1 and 2 being designated by the same reference number. The evaporator assembly 120 is provided with an outer annulus 13 having a contained volume, and annulus 13 is connected to a substantial portion of the periphery of the freezing faces 12 of evaporator assembly 120. Flow guides 67 are provided at the edges of each freezing face 120 to stop flow of liquid off of freezing faces 12. The annulus 13 has an entry port 14 and an exit port 15. Annulus 13 is connected to the freezing faces 12 and substantially surrounds the chamber 16 with the periphery of the freezing faces 12 being closed off by sheet metal in these portions of the freezing faces 12 not connected to annulus 13. Means for defining a narrow continuous chamber 123 with the freezing faces 12 is provided in the form of affixed pressure plates 121 with chamber 123 surrounding islands 129 where each freezing face 12 is bonded to its affixed pressure plate 121. The bonding of freezing faces 12 to the pressure plate 121 is conducted according to any of the known methods for metal or pressure bonding. Each freezing face 12 and the affixed plate 121 form a narrow chamber (or working volume) 123 that receives the liquid refrigerant during the freezing cycle through port 125 to pipes 127 (one pipe 127 for each chamber 123) or discharges the hot compressor discharge gas during the harvest cycle through port 125. Each freezing face 12 and affixed plate 121 defines a narrow chamber 123 so that any gases or liquids in the narrow chambers 123 are in thermal contact with the freezing faces 12. Port 125 is shown in FIG. 3 passing through outer annulus 13, however, port 125 only occupies a portion of the cross section of annulus 13 enabling flow in annulus 13 past port 125. Port 125 extends across the central reservoir 16 above annulus 13 and is connected to pipes 127 and pipes 127 are connected to the narrow chambers 123. The two metal sheets forming the freezing faces 12 extend across and cover port 125 and annulus 13 and below annulus 13 on the lower edge of assembly 120 the two metal sheets converge to form segment 126 having a narrowing cross section such as a triangular cross section. Segment 126 thus has a narrowing cross section in the direction away from annulus 13 and is provided as an inaccessible dead space. Liquid flowing across the freezing faces 12 follows the surface of segment 126 to drainage guide 20 which is the extension of the metal sheets forming segment 126.

A brief discussion of the portion of the cycle relevant to the evaporator assembly 120 of FIGS. 3 and 4 will now be given as though the evaporator assembly 120 were substituted for evaporator assembly 11 in FIG. 1. During the cooling part of the cycle, the liquid refrigerant enters port 125 and flows through port 125 to pipes 127 that are connected to the two narrow chambers 123. The liquid and gaseous refrigerant exit at ports 124 into line 44 (shown in FIG. 1). During the harvest cycle, the hot compressor discharge gas enters inlet 14 to annulus 13 and flows through annulus 13 to exit 15 that connects to line 61 (shown in FIG. 1) which in turn leads to line 44 (shown in FIG. 1), ports 124 and narrow chambers 123. This embodiment also produces one of the unique advantages of the method of this invention in that the hot compressor discharge gas makes a complete circuit through outer annulus 13 before entering line 61 (shown in FIG. 1) and passing through check valve 62 (shown in FIG. 1) into lines 44 (shown in FIG. 1) and then passing into narrow chambers 123. This results in the initial thawing of the frost bond between the frozen sheet and the frozen faces at the outer periphery of the freezing faces, the portion from which it is most difficult to release the frost bond by past experience in a plate type freezing apparatus.

Overflow trough means (overflow trough) 135 here shown in the form of a longitudinally cut pipe has a multiplicity of notches 137 and these notches 137 serve as liquid guides directing the liquid onto freezing faces 12. The overflow trough 135 is adjustably mounted on the flat surface of annulus 13 of evaporator assembly 120 with vertically positioned screws 138 being positioned for raising or lowering (i.e., horizontally levelling) the trough 135 and horizontally positioned clamping means 139 being provided for the purpose of transversely leveling the trough 135.

Since there is one port 124 for each narrow cavity 123 of the evaporator assembly 120 in FIGS. 3 and 4, it is necessary to modify FIG. 1 to have two lines 44 (shown in FIG. 1) leading from the accumulator 43 (FIG. 1) to connect to the two ports 124. It is also necessary to have line 61 have two branches to connect to the two lines 44.

Figure 5:
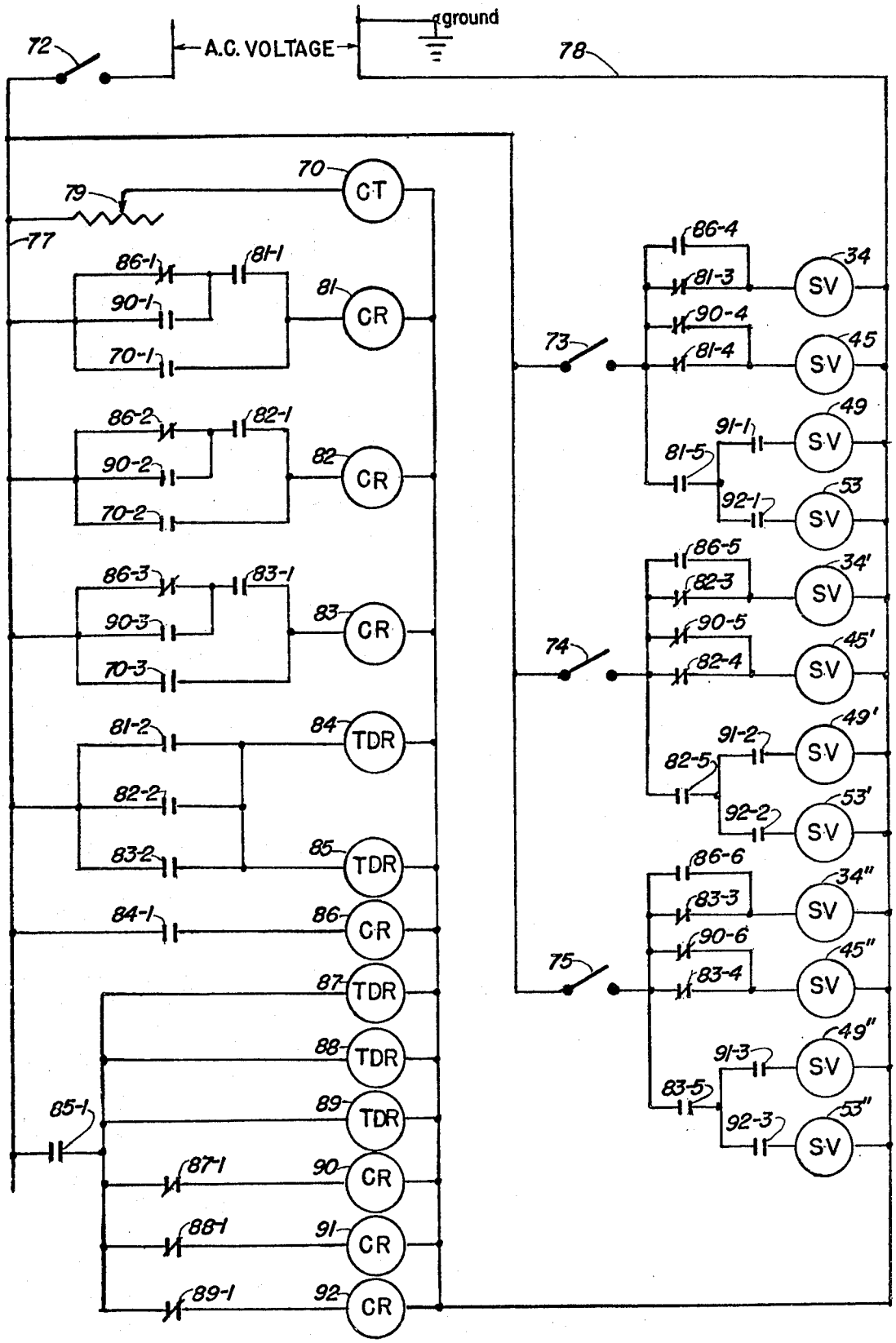
FIG. 5 is a schematic view of the timing and control circuitry used to operate the freezing apparatus.

The freezing apparatus of this invention can have an electrical control circuit for automatic operation, and a representative electrical control circuit is set forth in FIG. 5 which provides several advantages over previous icemakers. In particular using the electrical control circuit of FIG. 5 enables a corresponding change in the thickness of the ice produced by making a change in a calibrated control means on potentiometer 79. The ice hardness can be changed by a change in a calibrated dial on an adjustable time delay relay 84. Further the electrical control circuit in combination with the freezing apparatus offers great flexibility in its operation.

In FIG. 5 the flexibility of the electrical control circuit can be readily appreciated by the person skilled in the art of making ice. Here the solenoid valves have the same numbers as used in FIG. 1, and the solenoid valves are shown for three different evaporator assemblies with a single apostrophe or a double apostrophe being used for the second and third evaporator assemblies (11' and 11") respectively. All of these valves are opened on energization of the solenoid contained in the valve, and are closed on de-energization of the solenoid contained in the valve. It is possible to form a module of two or more assemblies being controlled by a common set of solenoid valves (e.g. solenoid valves 34, 45, 49 and 53). This same circuitry can be employed for a greater number of modules (such as five or more) by adding cams to the cam timer 70 and contacts to the control relays. The cam timer 70 has a drive motor and three normally open switches 70-1, 70-2 and 70-3 which are actuated by cam points in the cam timer 70. The speed of the motor of the cam timer 70 is regulated by a voltage source or potentiometer 79. Control relays 81, 82, 83, 86, 90, 91 and 92 have normally open and normally closed contacts to suit the number of modules as follows:

Relay 81 has normally open contacts 81-1, 81-2 and 81-5 and normally closed contacts 81-3 and 81-4;

Relay 82 has normally open contacts 82-1, 82-2 and 82-5 and normally closed contacts 82-3 and 82-4;

Relay 83 has normally open contacts 83-1, 83-2 and 83-5 and normally closed contacts 83-3 and 83-4;

Relay 86 has normally open contacts 86-4, 86-5 and 86-6 and normally closed contacts 86-1, 86-2 and 86-3;

Relay 90 has normally open contacts 90-1, 90-2, 90-3 and normally closed contacts 90-4, 90-5 and 90-6;

Relay 91 has normally open contacts 91-1, 91-2 and 91-3; and

Relay 92 has normally open contacts 92-1, 92-2 and 92-3.

Solid state time delay relays 84 and 85 delay closing contacts 84-1 and 85-1 respectively on energization, and the delay is adjustable by means of a control means. Solid state time delay relays 87, 88 and 89 delay opening contacts 87-1, 88-1 and 89-1 respectively on energization and are also adjustable. Manual switch 72 applies control voltage to the controls through line 77 and switches 73, 74 and 75 are provided for assemblies 11, 11' and 11" respectively so that the components of the three evaporator assemblies may be serviced without shutting the entire unit off. A ground 78 is also provided for the electrical control circuit.

The operation of the electrical control circuit in conjunction with the ice making process will now be described. Switches 72, 73, 74 and 75 are all closed. With all evaporator assemblies in a freezing mode, the cam timer 70 would be in between the three high cam points which are 120° apart for the three assemblies 11, 11' and 11". All control relays are in a de-energized or normal position. Valves (water supply) 34, 34' and 34" are energized by normally closed relay contacts 81-3, 82-3 and 83-3 respectively. Suction valves 45, 45' and 45" are energized by the normally closed relay contacts 81-4 and 90-4, 82-4 and 90-5, and 83-4 and 90-6 respectively. Hot gas valves 49, 49' and 49" and valves 53, 53' and 53" are de-energized because relay contacts 81-5, 82-5, and 83-5 respectively are open. When the cam point for a given assembly is reached by the cam timer, that assembly's switch closes momentarily to begin the pre-harvest cycle. For instance, when the cam closes contact 70-1, the pre-harvest of assembly 11 begins. Control relay 81 is energized through contact 70-1 momentarily, but it is held in energized position through its own contact 81-1 and the normally closed relay contact 86-1. At the same instant, control relay contact 81-2 energizes time delay relays 84 and 85 and the water valve 34 is de-energized by the opening of contact 81-3 stopping the water to evaporator 11. Contact 81-4 is de-energized, but suction valve 45 is still energized through contact 90-4, and contact 81-5 closes the circuit to valves 49 and 53 which are still de-energized because contacts 91-1 and 92-1 are open. Time delay relay 84 can be adjusted for the length of time that the water will remain shut off throughout the harvest cycle. Time delay relay 85 can be adjusted to control the length of the pre-harvest or the time that refrigeration is still applied to ice after the water has been shut off to reduce the temperature of the ice and harden it. This adjustment allows the user to select the ice hardness to suit his needs quickly and easily. After this delay time, contact 85-1 closes energizing time delay relays 87, 88 and 89 and control relays 90, 91 and 92 through contacts 87-1, 88-1 and 89-1. Suction valve 45 is de-energized by contact 90-4, and gas valve 49 is energized by contact 91-1 and valve 53 is energized by contact 92-1. The normally open contacts for control relays 90, 91 and 92 also operate in other module circuits, but since control relays 82 and 83 are de-energized, the normal refrigeration mode of those modules is not affected. Referring to FIGS. 1 and 2, hot gas is now entering annulus 13 and passing through the check valve 62 into the top of chamber 16 forcing liquid out through valve 53. After the adjustable delay period, time delay relay 89 de-energizes control relay 92 through contact 89-1 which de-energizes drain valve 53 through contact 92-1. The dial adjustment on this control simplifies the modification of drain time to suit exterior system characteristics including suction pressure, hot gas pressure and the presence of oil in the refrigerant. After valve 53 closes, the pressure in the cavity 16 rises to the control point according to the setting of pressure regulating valve 55. Due to the difference in coefficients of linear expansion between the ice and the freezing face 12, cracks in the sheet of ice will form while still on the vertical surface. Next, the ice separates from the face 12 and falls striking portions 37 of trough 35 and exiting through discharge chute 39. Shortly after this occurs, adjustable time delay relay 88 will de-energize control relay 91 through contact 88-1 which causes contact 91-1 to de-energize hot gas valve 49. The adjustable feature of this relay 88 allows compensation for the different time intervals required to suit the thickness of ice being made. After a suitable interval, time delay relay 84 energizes control relay 86 through contact 84-1 which energizes water valve 34 through contact 86-4. At the same time, contact 86-1 breaks its circuit to control relay 81 but contact 90-1 was closed when time delay relay 85 caused energization of control relay 90 through contacts 85-1 and 86-1. The cold water is now flowing over the freezing faces 12, reducing the pressure so that there will not be a large sudden release of pressure to the accumulator 43 when the valve 45 re-opens. Finally, adjustable time delay relay 87 de-energizes control relay 90 closing contact 90-4 to open suction valve 45 and de-energizing control relay 81 through contact 90-1. This de-energizes contact 81-2 to time delay relays 84 and 85 and contact 81-5 to valves 49 and 53. At the same time, it energizes contacts 81-3 to water valve 34 and 81-4 to suction valve 45. All contacts have returned to freezing mode position, and the cycle is repeated. The foregoing description is for the operation of the harvest cycle of assembly 11 only, however the sequence and operation would be the same for assemblies 11' and 11''.

Another variable handled by the control circuit of this invention is the dryness of the ice, and the time delay after the water valve closes stopping the flow to the overflow trough determine the dryness of the ice. Poultry wet pack ice has no dryness requirement, but ice to be bin stored should be dry to prevent fusing together of fragments into heavy chunks which are not readily conveyed or broken up for use.

A further advantage of the control circuit of this invention is to provide dial adjustable timing so that the operator can be instructed to make proper adjustments without the expense of paying for refrigeration service company personnel to make complicated cam adjustments as required on many ice makers.

The freezing apparatus of this invention has several features providing advantages over existing ice making equipment and methods.

The freezing apparatus of this invention offers several advantages in operation including the ease of making changes in the thickness and hardness of the ice produced. The thickness and the hardness of the ice produced can be changed rapidly by a change in the instrumentation controlling the operating cycle. The evaporator assemblies are identical in all models so that units of small or large size require an inventory of the same limited number of spare parts for maintenance. There are no mechanical parts required for removing the ice from the freezing faces or for conveying the ice from the freezing faces to the storage area. The ice sheets drop from the freezing faces of the evaporator assembly and fragment on the protruding breaker portions of the recipient trough without the aid of any moving mechanical parts and without the consumption of energy.

Still additional advantages of this invention include a minimization of power requirements due to low cooling inertia of the freezing faces of the evaporator assembly. No dryer belt is required to drain water from the fragmented ice before storage and this saves on initial capital and operating costs.

The apparatus of this invention has components that can be maintained in a sanitary condition to meet United States Department of Agriculture standards for icing food products in a sanitary manner. Also the apparatus of this invention has components that are completely safe for operating personnel and meet the requirements of the Office of Safety and Health Administration.

Specific components of the freezing apparatus of this invention provide improvements in operation. The outer annulus of the evaporator assemblies serves to prevent ice buildup beyond the freezing faces of the evaporator assembly and speeds harvesting of the ice sheets since the annulus first receives the hot gases to melt the frost bond at the outer portions of the ice sheet. The fact that the overflow trough can be adjustably mounted on the evaporator assembly enables uniform delivery of liquid to the freezing faces of the evaporator assembly. Also the separation of the outer annulus from the central reservoir prevents freezing of the liquid beyond the freezing faces.

Although this invention has been described with specific reference to particular embodiments thereof, it is to be understood that this invention is not to be so limited, since changes and alterations therein may be made which are within the full intended scope of this invention as defined by the appended claims.

What is claimed is:

1. A freezing unit comprising (a) at least one evaporator assembly with two freezing faces positioned to be substantially vertical, said freezing faces being planiform surfaces having connected at the periphery thereof an annulus defining a contained volume that runs along a substantial portion of the periphery of said freezing faces and with said freezing faces forms an enclosed central chamber, said chamber being interruptably connected to the contained volume of said annulus, (b) guide means being connected to said assembly for guiding liquid from said freezing faces, (c) trough means being mounted on said assembly to deliver liquid across said freezing faces, (d) liquid delivery means for delivering liquid to said trough means, and (e) recipient trough means positioned to receive liquid draining from said guide means and to discharge said liquid to said liquid delivery means, the recipient trough means having breaker portions comprised of substantially planer surfaces positioned at an angle to the path of the sheets of frozen liquid released from said freezing faces so that said sheets fall into contact with said planar surfaces and are broken into fragments.

2. A freezing unit according to claim 1 having in addition means for alternately heating and cooling said freezing faces being connected to said freezing faces of said assembly to form a freezing apparatus.

3. A freezing unit according to claim 2 in which the means for alternately heating and cooling said freezing faces being connected to said freezing faces has in an operative combination an accumulator, a refrigerant pump being connected to the liquid refrigerant side of the accumulator, a compressor, a condenser and a receiver.

4. A freezing unit according to claim 1 in which said guide means is attached to a segment which is attached to one portion of the annulus and said segment has a narrowing cross section, and said guide means is attached to and runs substantially along the length of said segment at substantially the center of the cross section of said segment.

5. A freezing unit according to claim 1 in which the evaporator assembly has a flat top surface and the trough means is adjustably mounted on said surfaces.

6. A freezing unit according to claim 1 in which the recipient trough means is comprised of a base with two protruding breaker portions being attached to said base to form a container with an opening for receiving liquid from said guide means.

7. A freezing unit according to claim 6 in which the two protruding breaker portions are attached to the base to form an angle in the range of about 15° to about 60° with the base.

8. A freezing unit according to claim 2 having in addition means for alternately heating and cooling said freezing faces being connected to said freezing faces and an electrical circuit being connected to said liquid delivery means and said means for alternately heating and cooling said freezing faces for automatic operation of the freezing apparatus, said electrical circuit containing timing means, a voltage source, switching means and a ground.

9. A freezing unit according to claim 1 wherein each freezing face has affixed thereto a pressure plate to form a narrow chamber between each freezing face and its affixed pressure plate, and each narrow chamber is interruptably connected to the contained volume of said annulus.

10. A freezing unit according to claim 3 wherein a line connecting the liquid refrigerant side of the accumulator to the evaporator assembly is connected to an accumulator return line having a drain valve, and said accumulator return line is capable of receiving the liquid refrigerant from the evaporator assembly upon initiation of a harvest portion of an ice making cycle.

11. A freezing apparatus comprising, in combination, (a) at least one evaporator assembly with two freezing faces, said freezing faces being planiform surfaces having connected therebetween an outer annulus having a contained volume that runs along a substantial portion of the periphery of the freezing faces and forms a central chamber, each freezing face has affixed on the back thereof a pressure plate to form a narrow chamber between each freezing face and its affixed pressure plate, and each narrow chamber is interruptably connected to the contained volume of said annulus, (b) guide means being connected to said assembly for guiding liquid from said freezing faces, (c) trough means being mounted on said assembly to deliver liquid across said freezing faces, (d) liquid delivery means for delivering liquid to said trough means, (e) means for alternatively heating and cooling said freezing faces being connected to said evaporator assembly, and (f) recipient trough means positioned to receive liquid draining from said guide means and discharging the liquid to said liquid delivery means, the recipient trough means having breaker portions comprised of substantially planar surfaces positioned at an angle to the path of the sheets of frozen liquid released from said freezing faces so that said sheets fall into contact with said planar surfaces and are broken into fragments.

12. A freezing apparatus according to claim 11 in which the trough means is fixedly mounted on said assembly.

13. A freezing apparatus according to claim 11 in which the trough means is adjustably mounted on said assembly.

14. A freezing apparatus according to claim 10 in which the freezing faces of said assembly are inclined from the vertical.

15. A freezing apparatus according to claim 10 in which said freezing faces of said assembly are inclined in opposite directions from the vertical.

16. A freezing apparatus according to claim 10 in which said freezing faces of said assembly are inclined in opposite directions from the vertical and at substantially the same angle from the vertical.

17. A freezing unit comprising (a) at least one evaporator assembly with two freezing faces, said freezing faces being planiform surfaces, and said freezing faces having connected therebetween an outer annulus having a contained volume that runs along a substantial portion of the periphery of the freezing faces and with said freezing faces forms a central chamber, said chamber being interruptably connected to the contained volume of said annulus, (b) guide means being connected to said assembly for guiding liquid from said freezing faces, (c) trough means being mounted on said assembly to deliver liquid across said freezing faces, (d) liquid delivery means for delivering liquid to said trough means, and (e) recipient trough means positioned adjacent to said evaporator assembly to receive liquid draining from said guide means and discharging the liquid to said liquid delivery means, the recipient trough having breaker portions comprised of substantially planar surfaces positioned at an angle to the path of the sheets of frozen liquid released from said freezing faces so that said sheets fall into contact with said planar surfaces and are broken into fragments.

18. A freezing unit according to claim 17 having in addition means for alternately heating and cooling said freezing faces being connected to said freezing faces of said assembly to form a freezing apparatus.

19. A freezing unit according to claim 18 in which the means for alternately heating and cooling said freezing faces being connected to said freezing faces has in an operative combination an accumulator, a refrigerant pump being connected to the liquid refrigerant side of the accumulator, a compressor, a condenser and a receiver.

20. A freezing unit according to claim 17 in which a segment is attached to one portion of the annulus and said segment has a narrowing cross section, and said guide means is attached to and runs substantially along the length of said segment.

21. A freezing unit according to claim 20 in which said guide means is attached to said segment at substantially the center of the cross section of said segment.

22. A freezing unit according to claim 17 in which the evaporator assembly has a flat top surface and the trough means is adjustably mounted on said surfaces.

23. A freezing unit according to claim 17 in which the recipient trough means is comprised of a base with two protruding breaker portions being attached to said base to form a container with an opening for receiving liquid from said guide means.

24. A freezing unit according to claim 23 in which the two protruding breaker portions are attached to the base to form an angle in the range of about 15° to about 60° with the base.

25. A freezing unit according to claim 17 having in addition means for alternately heating and cooling said freezing faces being connected to said freezing faces and an electrical circuit being connected to said liquid delivery means and said means for alternately heating and cooling said freezing faces for automatic operation of the freezing apparatus, said electrical circuit containing adjustable timing means, a voltage source, switching means and a ground.

26. A freezing unit according to claim 11 in which the trough means comprises an overflow trough means and is adjustably mounted on said assembly.

* * * * *